US006234469B1

(12) United States Patent
Jinnai et al.

(10) Patent No.: US 6,234,469 B1
(45) Date of Patent: May 22, 2001

(54) MONEY PROCESSING APPARATUS AND METHOD

(75) Inventors: Naohiro Jinnai; Tetsuji Kawasaki; Toshinori Henmi, all of Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/300,268

(22) Filed: Apr. 27, 1999

(30) Foreign Application Priority Data

May 13, 1998 (JP) ..... 10-129791

(51) Int. Cl.[7] ..... B65H 5/22; B65H 85/00

(52) U.S. Cl. ..... 271/3.04; 271/3.05; 271/3.01

(58) Field of Search ..... 235/379, 475, 235/479, 486; 271/3.04, 3.05, 3.01

(56) References Cited

U.S. PATENT DOCUMENTS

| | | | | |
|---|---|---|---|---|
| 4,219,191 | * | 8/1980 | Rastorguyeff | 271/3.07 |
| 4,451,138 | * | 5/1984 | Anderson | 399/373 |
| 4,589,645 | * | 5/1986 | Tracy | 271/3.03 |
| 4,611,800 | * | 9/1986 | Parsons et al. | 271/3.04 |
| 4,637,598 | * | 1/1987 | Bouwens et al. | 271/3.04 |
| 4,639,126 | * | 1/1987 | Bushaw et al. | 399/364 |
| 4,934,683 | * | 6/1990 | Ueda et al. | 271/3.04 |
| 5,076,559 | * | 12/1991 | Lawniczak | 271/3.11 |
| 5,169,135 | * | 12/1992 | Hamanaka et al. | 271/3.04 |
| 5,676,361 | * | 10/1997 | Garbe | 271/3.04 |
| 5,755,434 | * | 5/1998 | Takatoshi et al. | 271/3.05 |
| 5,836,577 | * | 11/1998 | Arikawa et al. | 270/58.04 |
| 6,050,386 | * | 4/2000 | Niizuma | 194/206 |
| 6,076,818 | * | 6/2000 | Oda | 271/3.04 |

FOREIGN PATENT DOCUMENTS

| | | | | |
|---|---|---|---|---|
| 82979 | * | 7/1983 | (EP) | 271/3.04 |

* cited by examiner

*Primary Examiner*—Donald P. Walsh
*Assistant Examiner*—Daniel K Schlak
(74) *Attorney, Agent, or Firm*—Kanesaka & Takeuchi

(57) ABSTRACT

To determine the number of bills in a money processing apparatus, a dividing pin enters a bill housing via a guide groove to fall onto the top of the accumulated bills. The bills are circulated through a transport path, while identification of bill type and counting are executed. When sensors detect that the pin has reached the lowest point, the whole bills have once circulated through the transport path. The pin is withdrawn from the bill housing and is moved to a standby position. Number of bills in the bill housing is accurately and easily determined.

10 Claims, 9 Drawing Sheets

MONEY PROCESSING APPARATUS AND METHOD

BACKGROUND OF THE INVENTION AND RELATED ART STATEMENT

The present invention relates to a money processing apparatus and method, in particular, it is used in a distribution industry, such as supermarkets and convenience stores, the money processing apparatus being connected to a POS (point of sales) register to total the amount of input bills.

In the money processing apparatuses used for store registers, cash delivery or exchange operations with customers are currently being streamlined, and the cash registers connected to the POS terminals are now getting popular now. A money processing apparatus has recently been developed to automatically process input or output coins or bills in response to information input through the POS terminal. Money processing apparatuses are generally classified into a coin processing apparatus and a bill processing apparatus. A money processing apparatus in which coin and bill-processing apparatuses are integrated and miniaturized to a size of a cash drawer to permit installation under the POS terminal has been proposed.

FIG. 9 is a perspective view illustrating the money processing apparatus. The installation area of the money processing apparatus 1 is reduced to be as compact as that of a POS register 2, so that the apparatus 1 may be placed under the register 2. The money processing apparatus 1 is integrally united by placing a bill-processing section 6 and a coin processing section 9 in parallel. The bill-processing section 6 includes a bill input port 3, a bill output port 4, and a bill collecting housing 5 on its front surface. The coin processing section 9 includes a coin input port 7 and a coin output port 8 on its front surface.

Bills are input from the bill input port 3. Bills for change are output from the bill output port 4 on a command from the POS register 2. The bill collecting housing 5 separately houses ten-thousand-yen bills which are not used as a change. When various types of coins are simultaneously input from the coin input port 7, they are sequentially transported to the interior of the coin processing section 9, which are separated by coin-types during the transfer and are stored in different locations. For example, when the POS register 2 sends instructions to provide change, predetermined types and numbers of coins are output from the coin output port 8.

FIG. 10 is a side view showing an example of an internal structure of the bill-processing section. The bill-processing section 6 has input-bill rollers 11, an input-bill identifying section 12, a blade roller 13, and a bill housing 14 on the downstream side of the bill input port 3. A presser plate 15 that presses accumulated bills 10 downwards is supported on an oscillating shaft 20 of the bill housing 14 to permit oscillation. A supply roller 25 that feeds accumulated bills 10 in the horizontal direction from the bottom of the bills is placed at the bottom of the bill housing 14. A separation and delivery section 16 that sequentially separates and delivers one bill, a delivered-bill transport section 17, and an output-bill identifying section 18 are located on the downstream side of the supply roller 25.

An output-bill transport section 19 leading to the bill output port 4 is located on the downstream side of the output-bill identifying section 18. In addition, an output-bill gate 21 and a collecting gate 22 for switching a transport path are located on the downstream side of the section 18, and a collected-bill transport section 23. leading to the bill collecting housing 5 is provided behind the collecting gate 22. A circulating transport section 24 is provided to guide the bills delivered from the bill housing 14 back to the bill housing 14.

The function of the bill-processing section 6 will be described in detail along a bill transport route. First, bills input from the bill input port 3 are pulled by the opposed input-bill rollers 11. The input-bill identifying section 12 is located on the downstream side of the input-bill rollers 11 to identify the input bills. The bills are normally input one at a time, but when, for example, change is supplied to the apparatus, multiple bills can be simultaneously input to reduce the bill input time.

The input bills are transported and sequentially aligned and accumulated in the bill housing 14 from its top while pushing up the presser plate 15. The presser plate 15 presses the bills 10 accumulated in the bill housing 14 at a position generally corresponding to the center and opposed to the supply roller 25, while the blade roller 13 presses the other end of the bills. This configuration enables stable accumulation by preventing succeeding bills from colliding against the bills 10 already housed.

One end of the presser plate 15 is fixed to the oscillating shaft 20 to support the plate 15 to permit oscillation. The plate 15 presses the bills 10 with its own weight only. For output, the supply roller 25 rotates to feed the bills 10 accumulated in the bill housing 14 to the right of the figure and sequentially from the bottom, and the separation and delivery section 16 sequentially separates and delivers one bill from the others. The delivered-bill transport section 17 transports the delivered bills. The output-bill identifying section 18 provided in the middle of the transport path determines the bill type.

Based on the results of the determination, bills to be output pass through the output-bill transport section 19 and are aligned and accumulated in the bill output port 4. For the bills need not be output as a change, such as ten-thousand-yen bills, the output-bill gate 21 and collecting gate 22 operate to pass these bills through the collected-bill transport section 23 in order to align and accumulate them in the bill collecting housing 5. For unidentifiable bills, only the output-bill gate 21 operates to pass these bills through the circulating transport section 24 to re-house them in the bill housing 14.

According to the bill-processing apparatus of the above structure, when the bills are sequentially input, the input-bill identifying section can identify the bill types, so that bills can be counted based on the results of identification to determine the number of bills in the bill housing. If the supply of change in the apparatus runs out and requires re-supply, multiple bills can be input simultaneously in order to reduce the input time. In this case, the input-bill identifying section can not identify the types and numbers of the input bills, so that the number of the bills in the bill housing is unknown.

The present invention has been made in view of the above, and the object of the present invention is to provide a bill-processing apparatus that can accurately and easily count the number of bills in the apparatus, even when multiple bills are simultaneously input.

Another object of the invention is to provide a method of counting the number of bills in the bill-processing apparatus easily and accurately.

SUMMARY OF THE INVENTION

In order to attain the objects, the invention provides a money processing apparatus for processing input and output bills, which comprises input-bill transport means for transporting input bills; bill housing means for sequentially accumulating and storing bills transported by the input-bill transport means; separation and delivery means for sequentially separating one bill from others accumulated in the bill housing means for delivery therefrom; delivered-bill transport means for transporting the bill delivered by the separation and delivery means; output-bill identifying means for identifying the bill type during the transport executed by the delivered-bill transport means; switching gate means for switching a bill transport direction between a bill output port and the bill housing means; output-bill transport means for transporting to the bill output port the bills whose transport direction has been switched to the bill output port; circulating transport means for transporting to the bill housing means the bills whose transport direction has been switched to the bill housing means; and accumulated-bill dividing means provided on a wall surface of the bill housing means, which is used for totaling the number of the bills by dividing uncounted bills from counted bills circulated by the circulating transport means.

In such a money processing apparatus, in order to total the number of bills within the apparatus, the accumulated-bill dividing means is moved to the top of the bills accumulated in the bill housing means; the housed bills are delivered and transported; and during the transport, the output-bill identifying means identifies the bill types and counts the number of the bills. The circulating transport means re-houses the counted bills in the bill housing means. At this point, the re-housed bills are accumulated on the accumulated-bill dividing means. This step allows the dividing means to divide the uncounted bills from the counted bills circulated by the circulating transport means. These operations are repeated, and when no uncounted bills remain in the bill housing means, the dividing means has reached the lowest point. At this point, the bills in the bill housing means have traveled through their transport path to complete totaling.

DETAILED DESCRIPTION OF PREFERRED EMBODIMENTS

Examples in which embodiments of this invention are applied to a bill-processing machine of a money processing apparatus will be described below with reference to the drawings.

Figure 1A:
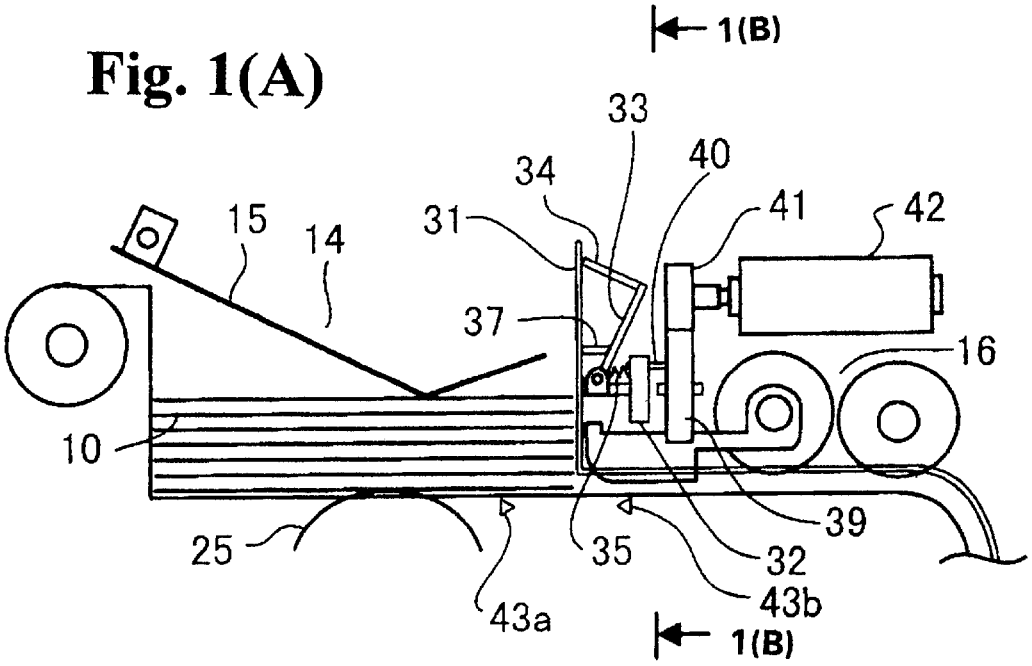
FIG. 1(A) shows a side view of a bill housing in a bill-processing machine.
Figure 1B:
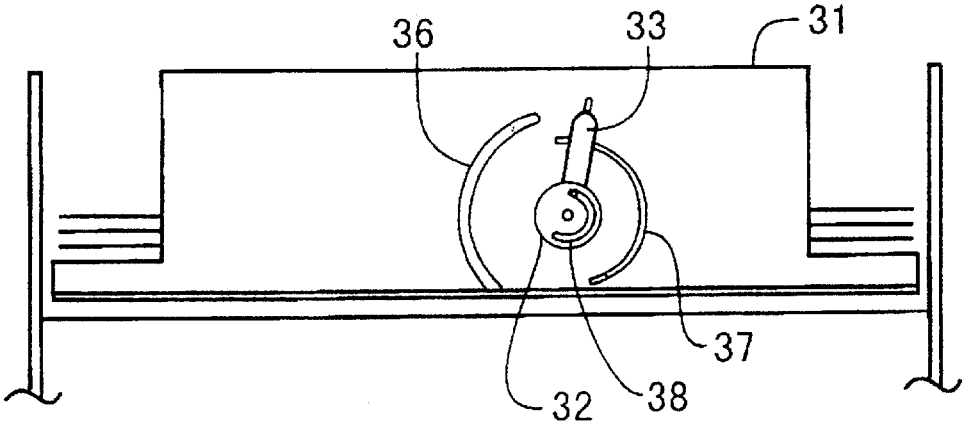
FIG. 1(B) is a view taken along line 1(B)—1(B) in FIG. 1(A)
Figure 10:
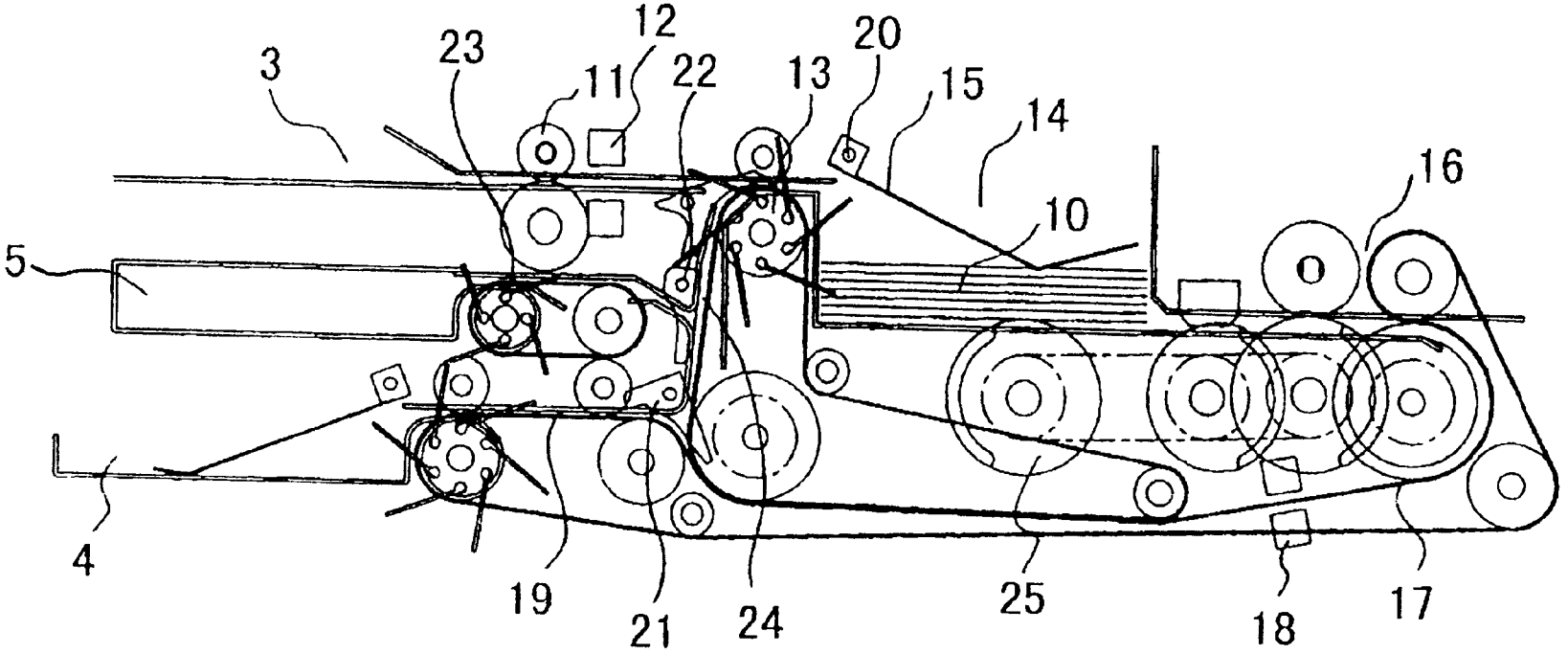
Fig. 10 Prior Art
FIG. 10 is a side view showing an example of an internal structure of a conventional bill-processing section.

FIG. 1(A) illustrates one side of a bill housing in a bill-processing machine, and FIG. 1(B) is a view taken along line 1(B)—1(B) in FIG. 1(A). In FIGS. 1(A) and 1(B), the components shown in FIG. 10 have the same reference numerals. The presser plate 15 that presses accumulated bills 10 from above by its own weight is supported in a bill housing 14 to permit oscillation. A supply roller 25 that feeds accumulated bills 10 horizontally from the bottom is placed at the bottom of the bill housing 14. A separation and delivery section 16 that sequentially separates and delivers one bill from others is placed on the downstream side of the supply roller 25.

An accumulated-bill dividing section is placed on the side of the separation and delivery section 16 in the bill housing 14. The dividing section divides uncounted and counted bills 10 accumulated in the bill housing 14 while calculating the number of bills in the apparatus, and has a roller 32 rotatably supported on a bill housing wall surface 31. A dividing arm 33 is provided on a rotating shaft of the roller 32. The dividing arm 33 is bendable and has a dividing pin 34 at its free end, which may be placed on the side of the bill housing wall surface 31. A spring 35 that presses the dividing arm 33 toward the bill housing wall surface 31 is placed between the roller 32 and the dividing arm 33. A semicircular guide groove 36 concentric with the rotating shaft of the roller 32 is cut in the bill housing wall surface 31, as shown in FIG. 1(B). The width of the guide groove 36 is larger than the diameter of the dividing pin 34.

In addition, the bill housing wall surface 31 has a semicircular raised portion 37 concentric with the rotating shaft of the roller 32 and is tapered at both ends. A semicircular drive groove 38 is cut in the roller 32 so as to be concentric with its rotating shaft. A drive pin 40 fixed to a gear 39 is inserted into the drive groove 38 in the roller 32. The driving groove 38 has a width larger than the diameter of the drive pin 40 to avoid friction with the pin 40. The gear 39 engages a gear 41 coupled to a driving shaft of a motor 42. In addition, sensors 43*a* and 43*b* for detecting a rotational position, that is, the lowest point of the dividing arm 33 when all uncounted bills have been delivered from the bill housing 14, are provided on the bottom surface of the bill housing 14.

When the accumulated-bill dividing section is in a standby status, the dividing arm 33 rides on the raised portion 37, and the pin 34 at the tip of the arm 33 is withdrawn from the bill housing 14.

The structure and operation of the dividing arm 33 are described in detail below.

Figure 2A:
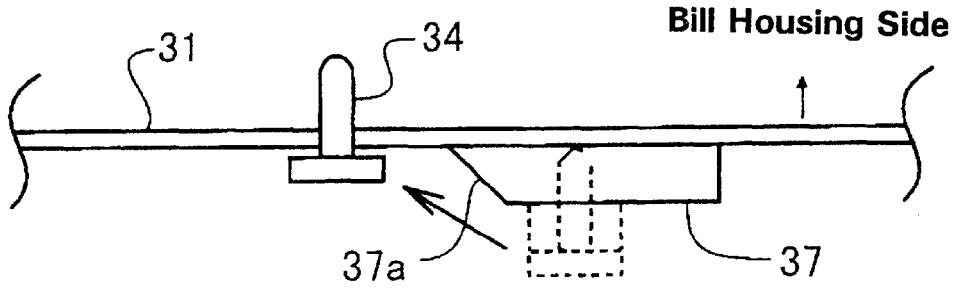
FIG. 2(A) shows an operation of a dividing arm at a start of counting as seen from above.
Figure 2B:
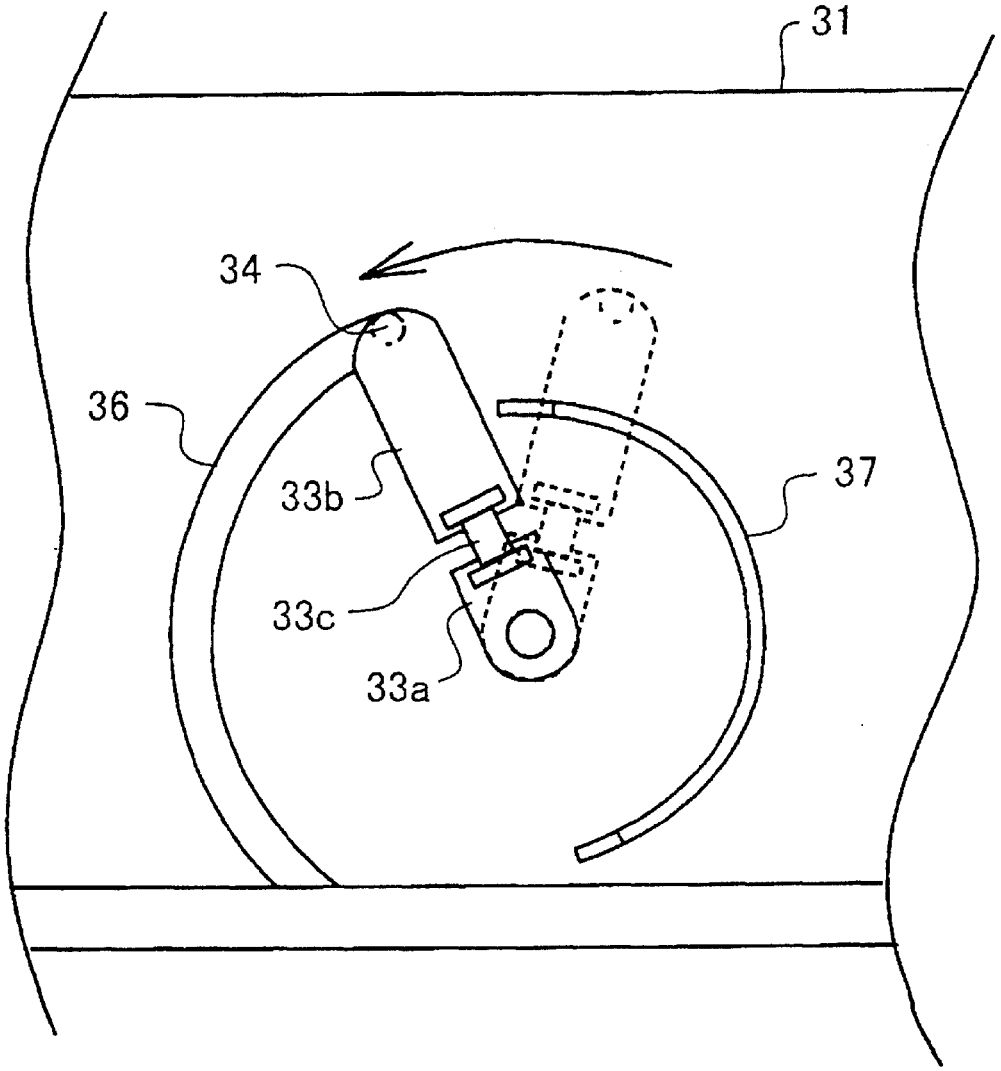
FIG. 2(B) shows the operation of the arm as seen from a side.

FIG. 2(A) shows the operation of the dividing arm at the start of counting, as seen from above, and FIG. 2(B) shows the operation of the arm as seen from the side. The arm 33 is composed of a fixed portion 33*a* attached to the rotating shaft of the roller 32, a movable portion 33*b*, and a joint portion 33*c* that joins these portions together. In the standby status, the arm 33 is located at the position indicated by the broken line, wherein the movable portion 33*b* rides on the raised portion 37 and is pressed against the raised portion 37 by the spring 35. In this state, the dividing pin 34 attached to the tip of the arm 33 is withdrawn from the bill housing 14.

When the counting begins, the roller 32 is rotated counterclockwise and the arm 33 is correspondingly rotated counterclockwise, as shown by the arrow. The movable portion 33*b* slides along the edge of the raised portion 37, and then along a tapered portion 37*a* thereof. The dividing pin 34 enters the guide groove 36 in the bill housing wall surface 31, with its tip entering into the bill housing 14. Subsequently, when the arm 33 rotates slightly past the vertical line, the motor 42 halts to allow the roller 32 to rotate freely. The arm 33 then rotates counterclockwise by its own weight until the pin 34 reaches the top surface of the bills 10 accumulated in the bill housing 14. The arm 33 then halts. Subsequently, the bills 10 are sequentially delivered from the bottom surface of the bill housing 14 in order to calculate the number of the bills. The number of the accumulated bills sequentially decreases, and the position of the pin 34 correspondingly and sequentially moves downward. The counted and circulated bills are accumulated again on the pin 34.

Figure 3A:
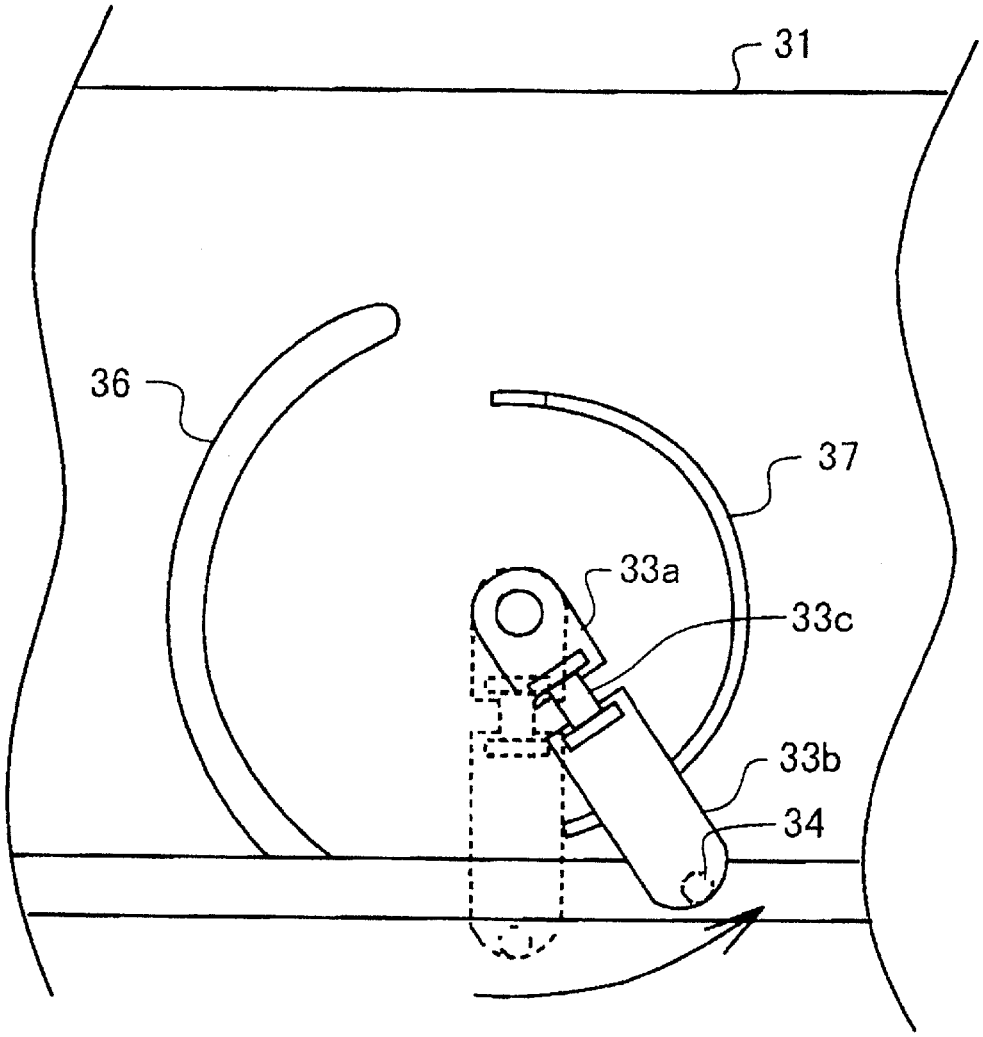
FIG. 3(A) shows the operation of the dividing arm at the end of counting as seen from the side.
Figure 3B:
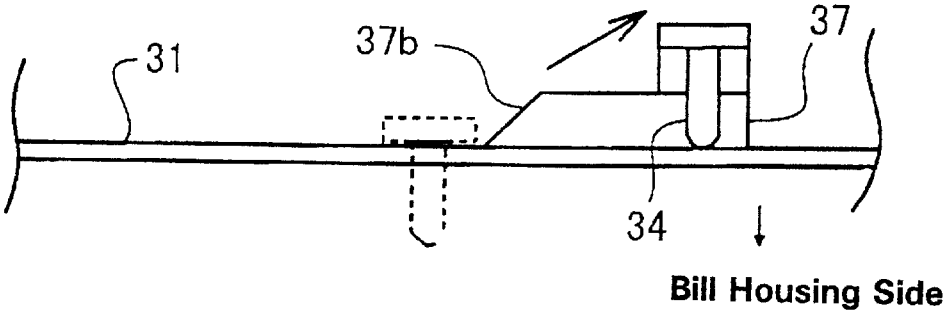
FIG. 3(B) shows the operation of the arm as seen from below.

FIG. 3(A) shows the operation of the arm after counting is finished, as seen from the side, and FIG. 3(B) shows the operation of the arm, as seen from below. When the counting progresses and all the bills under the dividing pin 34 have been removed, the pin 34 projects from the bottom surface of the bill housing 14 and halts at the position indicated by the broken line. In this position, the counting is finished, and when the accumulated-bill dividing section is to be returned to its standby position, the roller 32 together with the dividing arm 33 is rotated counterclockwise, as indicated by the arrow. The movable portion 33*b* climbs the tapered portion 37*b* of the raised portion 37 and rides on the raised portion 37. The pin 34 is withdrawn from the bill housing 14, and the roller 32 rotates, causing the movable portion 33*b* of the arm 33 to slide along the edge of the raised portion 37. The movable portion 33*b* halts upon reaching the standby position indicated by the broken line in FIGS. 2(A) and 2(B).

Detailed operations of the accumulated-bill dividing section during counting are described below.

Figure 4A:
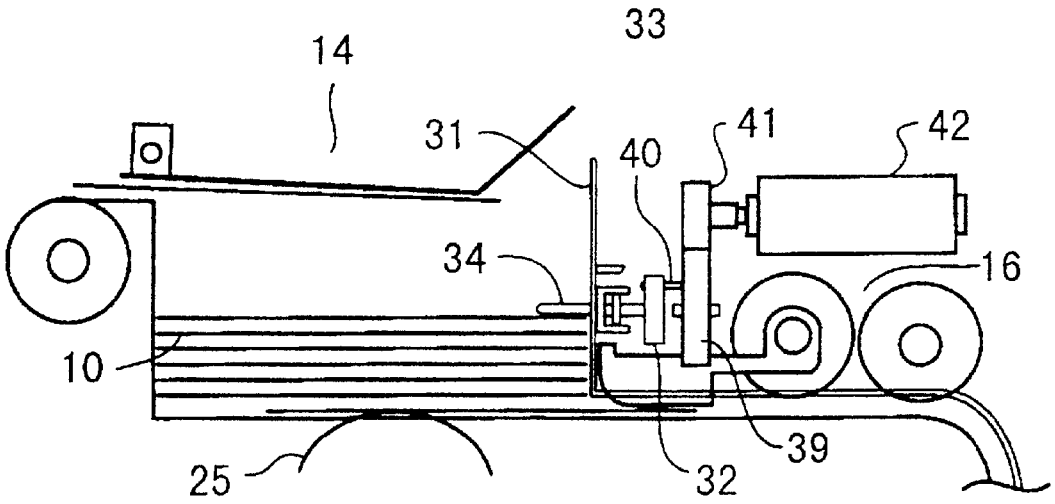
FIG. 4(A) shows a side of the bill housing at a counting status of an accumulated-bill dividing section.
Figure 4B:
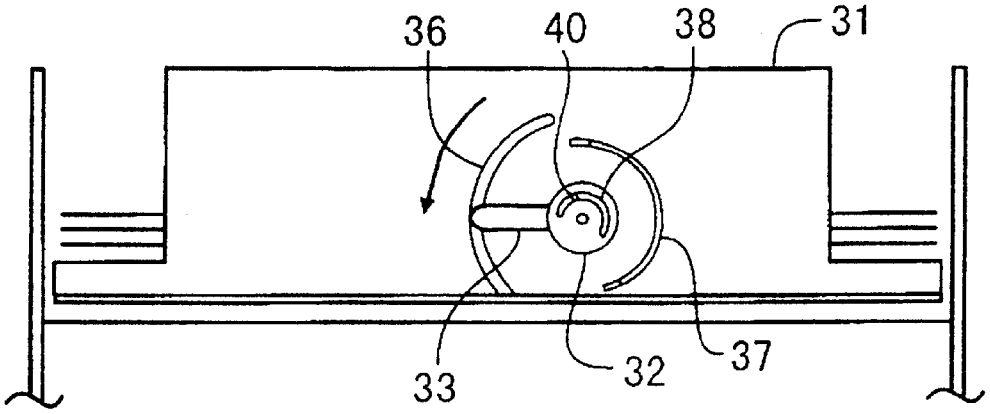
FIG. 4(B) shows the status of the dividing arm during counting.

FIG. 4(A) shows a side of the bill housing at the counting start status of the accumulated-bill dividing section, and FIG. 4(B) shows the status of the dividing arm after the counting starts. When the counting starts with the accumulated-bill dividing means in standby status shown in FIGS. 1(A) and 1(B), in response to operation instructions from the money-processing apparatus, the motor 42 operates to rotate the gears 41 and 39. Then, the drive pin 40 fixed to the gear 39 and inserted into the drive groove 38 rotates the roller 32 counterclockwise, thereby rotating counterclockwise the dividing arm 33 which have ridden on the raised portion 37.

As the rotation proceeds, the arm 33 leaves the raised portion 37 to cause the dividing pin 34 provided at the free end of the arm 33 to be inserted into the bill housing 14 through the guide groove 36 provided in the bill housing wall surface 31. Once the dividing arm 33 has been rotated through a predetermined angle past the vertical line, the rotation of the motor 42 halts to stop the drive pin 40 at that position. Since the inner wall of the circular drive groove 38 and the pin 40 are shaped and arranged to avoid frictional contact, the roller 32 continues to rotate as a result of the weight of the arm 33 even after the pin 40 has halted. This rotation halts when the pin 34 reaches the top surface of the bills 10 accumulated in the bill housing 14, as shown in the figures.

As the supply roller 25 sequentially delivers the bills 10 from the bill housing 14 to reduce the bills 10 in the bill housing 14, the pin 34 lowers correspondingly and sequentially. On the other hand, the output-bill identifying section identifies the bills delivered from the bill housing 14, and these bills pass through the circulating transport section and return to the bill housing 14, where they are accumulated on the pin 34. The counting is executed in this manner, and once all the bills under the pin 34 have been removed, the pin 34 falls to the bottom of the bill housing 14, as shown in FIGS. 5(A) and 5(B).

Figure 5A:
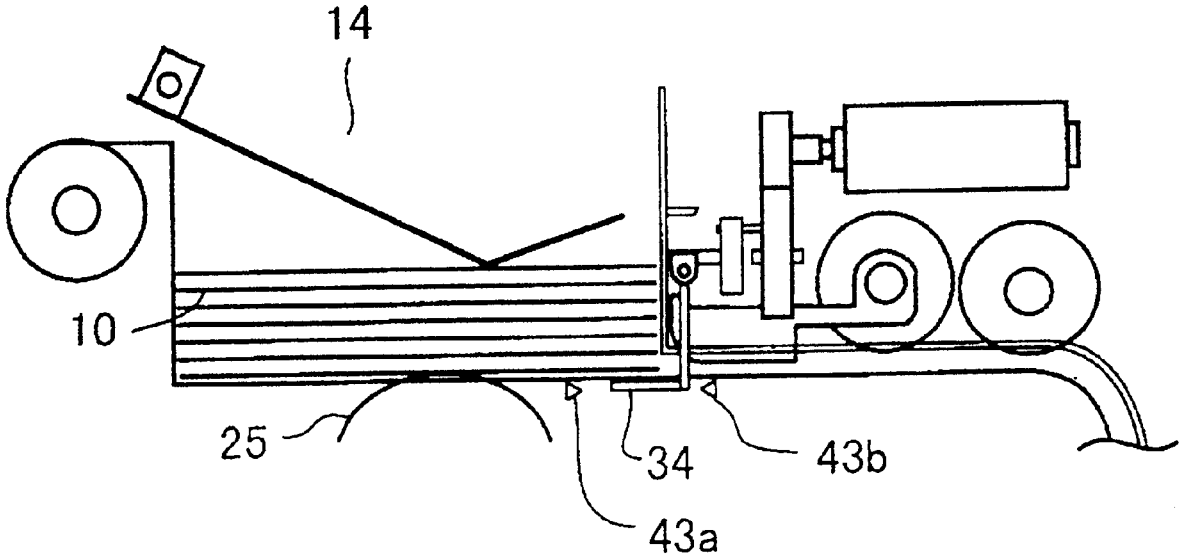
FIG. 5(A) shows a side of the bill housing at a counting end status of the accumulated-bill dividing section.
Figure 5B:
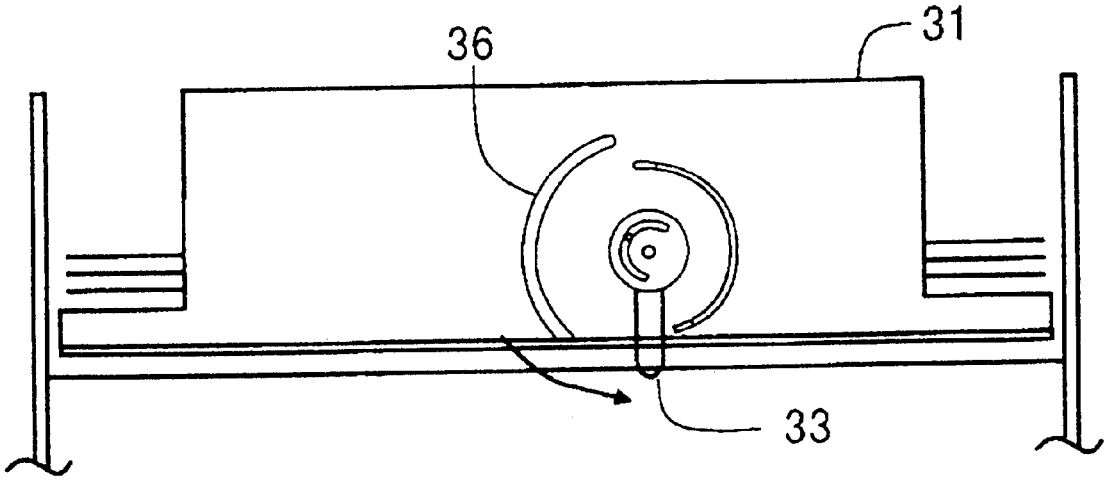
FIG. 5(B) shows the dividing arm at the counting end status.

FIG. 5(A) shows a side of the bill housing at the counting end status, while FIG. 5(B) shows the status of the dividing arm at the counting end position. Once all the uncounted bills have been removed from the bill housing 14 and the dividing pin 34 has moved out from the bill housing 14, the dividing arm 33 halts while being suspended in the vertical direction. The arm 33 blocks the bill-delivering transport path to block the counted bills in the bill housing 14 from further delivery. The sensors 43*a* and 43*b* are provided at the suspended position of the arm 33 to detect the rotational position of the suspending arm 33 to stop the supply roller 25, and thus the delivery of the bills. Subsequently, the accumulated-bill dividing section operates to move to the standby status as described below.

Figure 6A:
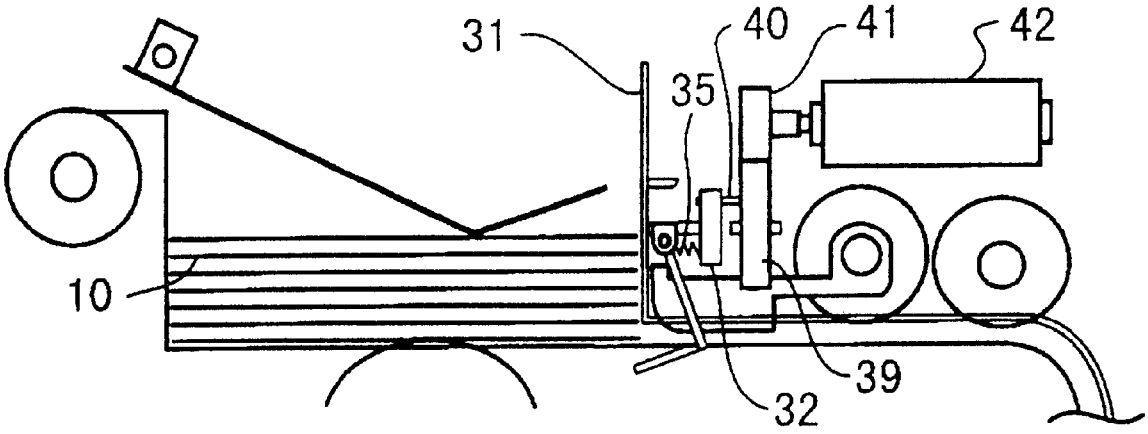
FIG. 6(A) shows a side of the bill housing at the accumulated-bill dividing section shifting to a standby position.
Figure 6B:
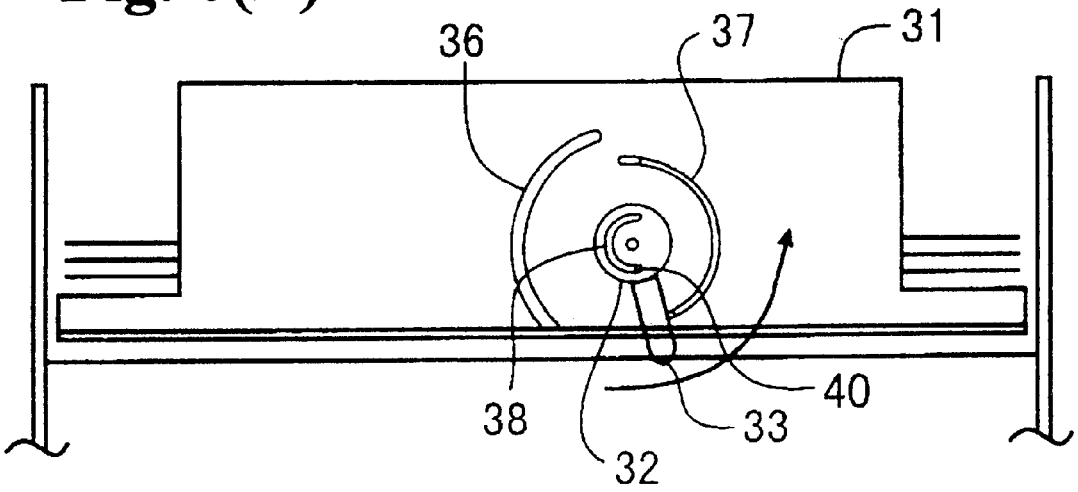
FIG. 6(B) shows the dividing arm during the shift to a standby position.

FIG. 6(A) shows a side of the bill housing when the accumulated-bill dividing section is shifted to the standby status, and FIG. 6(B) shows the status of the dividing arm during the shift to the standby status. After the supply roller 25 halts, the motor 42 starts to operate. The gear 39 is rotationally driven via the gear 41 to rotate the drive pin 40 fixed to the gear 39 along the drive groove 38 in the roller 32. Upon reaching the end of the circular drive groove 38, the pin 40 rotationally drives the roller 32. Correspondingly, the dividing arm 33 is rotationally driven. As the arm 33 climbs the tapered portion of the raised portion 37, its tip is lifted to move the tip of the dividing pin 34 on the bill housing wall surface 31. Subsequently, the arm 33 slides on the raised portion 37 while being pressed against the raised portion 37 by means of the spring 35. Once the dividing pin 34 reaches the standby position shown in FIGS. 1(A) and 1(B), the motor 42 is halted. The arm 33 halts rotational movement at that position due to the pressure of the spring 35 against the raised portion 37 and maintains in the standby status.

The process of the totaling operation of the money processing machine configured as described above is described below.

Figure 7:
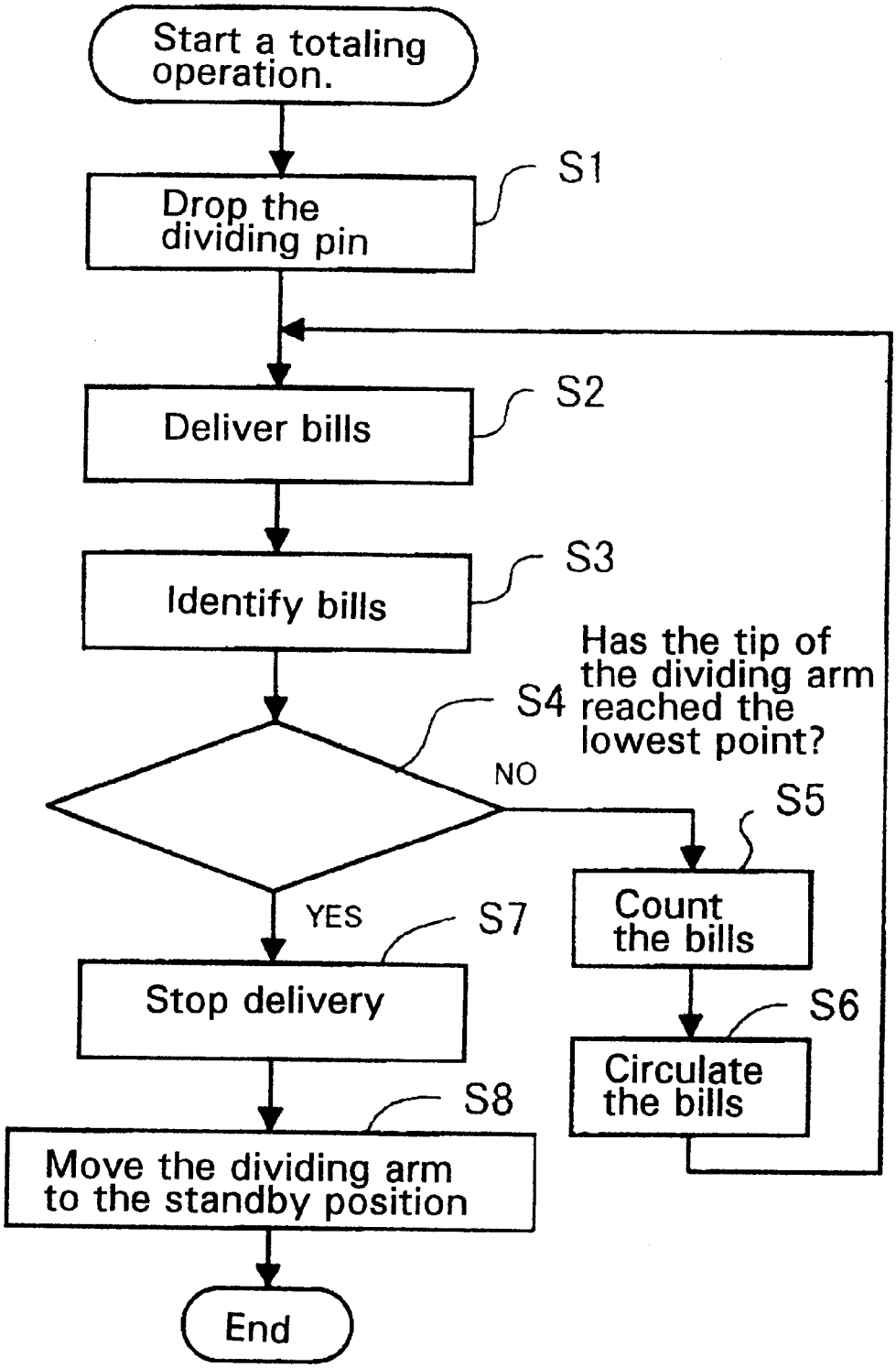
FIG. 7 is a flow chart illustrating the process of totaling.

FIG. 7 is a flow chart illustrating the process of totaling. When the totaling process starts, the dividing arm rotates to plunge the dividing pin into the bill housing to drop it onto the bills accumulated in the bill housing (step S1). The supply roller operates to deliver one bill from the bills accumulated in the bill housing (step S2), and the output-bill identifying section identifies the bill type (step S3). Then, it is determined whether the tip of the dividing arm has reached the lowest point (step S4). If the bills remain in the bill housing and the arm has not reached the lowest point, the bill determined by the identifying section is counted (step S5) and is circulated through the circulating transport path to return to the bill housing (step S6). Once the arm reaches the lowest point, all the uncounted bills have been delivered from the bill housing, and the supply roller is halted to stop delivery of the bills (step S7). The arm is moved to its standby position (step S8).

A second embodiment of a money-processing apparatus according to this invention is described below.

Figure 8:
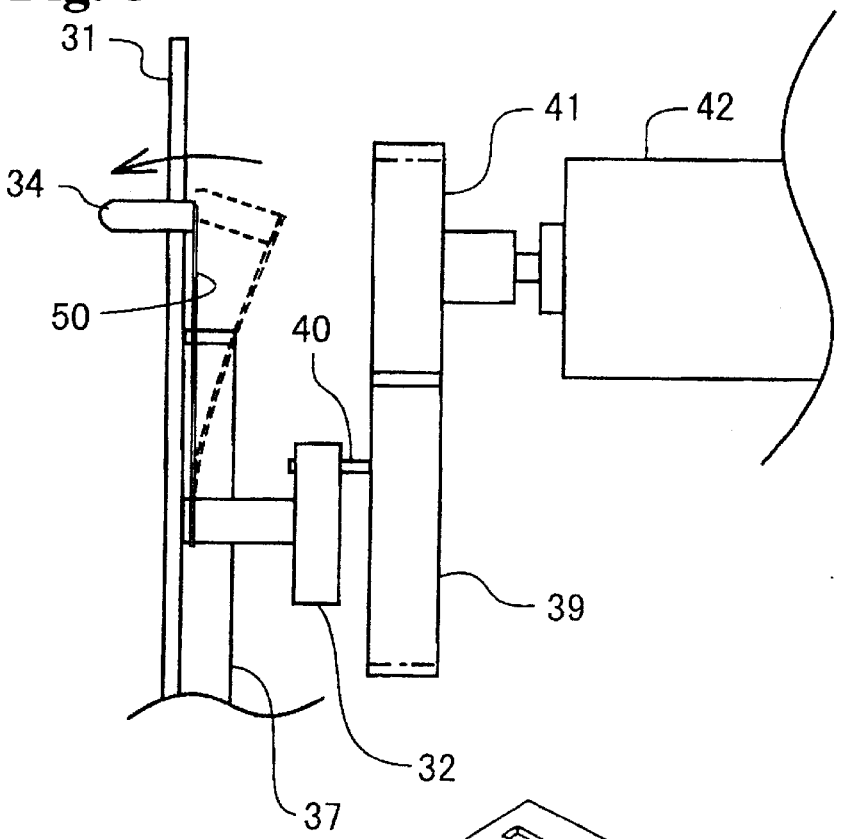
FIG. 8 shows a main part of an accumulated-bill dividing section of a bill-processing machine, according to the second embodiment.
Figure 9:
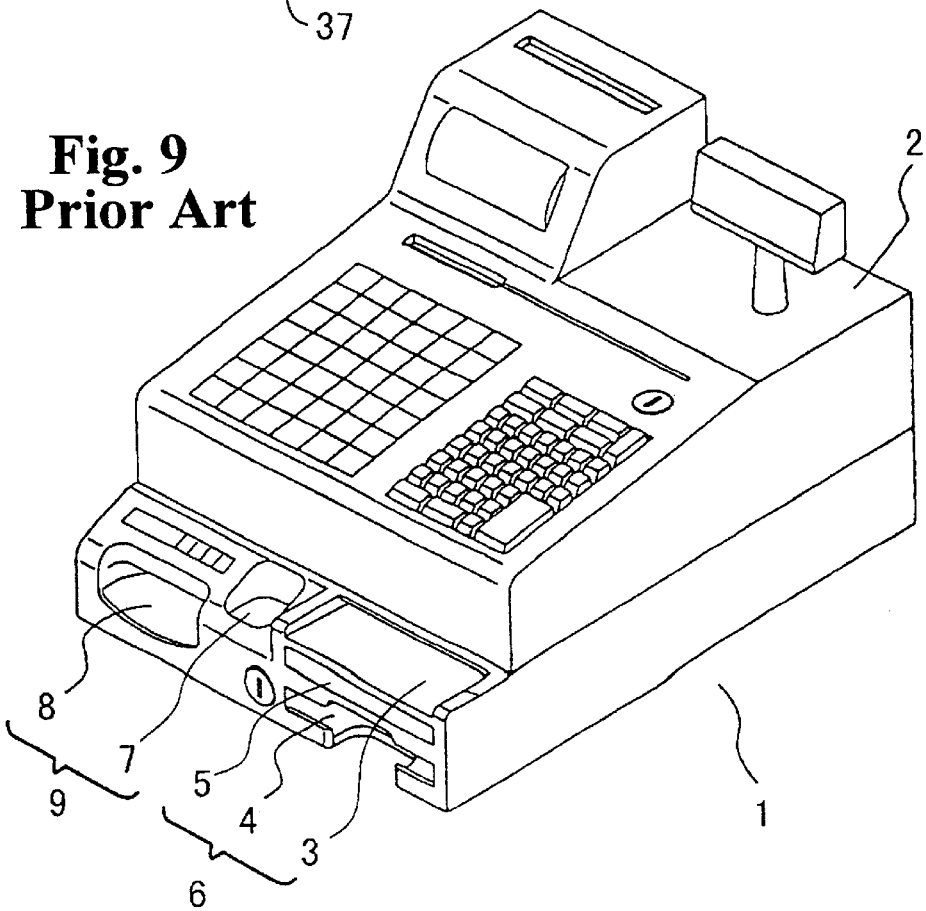
Fig. 9 Prior Art
FIG. 9 is a perspective view illustrating the conventional money-processing apparatus.

FIG. 8 shows a main part of an accumulated-bill dividing section of a bill-processing machine according to the second embodiment. In this figure, the same components shown in FIGS. 1(A) and 1(B) are labeled with the same reference numerals and their detailed descriptions are omitted. As shown in FIG. 8, a plate spring 50 is fixed to the rotating shaft of the roller 32 rotatably supported on the bill housing wall surface 31, and the dividing pin 34 is fixed to a free end of the plate spring 50. The plate spring 50 combines the functions of the arm 33 and the spring 35 of the accumulated-bill dividing section shown in FIGS. 1(A) and 1(B).

While the accumulated-bill dividing section is in the standby status, the plate spring 50 rides on the raised portion 37 provided on the bill housing wall surface 31 against its own spring force, as indicated by the broken line in FIG. 8, and the dividing pin 34 has been withdrawn from the bill housing. During the totaling operation, the motor 42 rotates, and the gears 41 and 39 rotate correspondingly to allow the drive pin 40 fixed to the gear 39 to rotate the roller 32. The plate spring 50 fixed to the rotating shaft of the roller 32 rotates and leaves the raised portion 37. It then returns to the position indicated by the solid line due to its spring force to plunge the dividing pin 34 into the bill housing. Subsequently, when the free end of the plate spring 50 is rotated past the vertical line and the rotational driving by the motor 42 is halted, the spring 50 rotates by its own weight and falls onto the accumulated bills.

Subsequently, when the delivery of the uncounted bills from the bill housing is completed and the spring 50 reaches the lowest point, the motor 42 operates again to rotate the gears 41 and 39 and the drive pin 40. Upon reaching the end of the drive groove in the roller 32, the pin rotationally drives the roller 32 to rotate the spring 50 from the lowest point. The spring 50 rides on the raised portion 37 to withdraw the dividing pin 34 from the bill housing. While maintaining this status, the spring 50 moves to the standby position.

As described above, this invention uses as a trigger the falling of the dividing pin onto the top of the accumulated bills to deliver the bills in the bill housing, in order to circulate them through the transport path, while identifying, counting and re-housing the bills. Once the pin reaches the lowest point, the delivery is finished, and the counting is completed. Even if multiple bills are simultaneously input, the bills in the bill housing can be counted as required, enabling the management of the bills.

In addition, since the dividing pin divides the uncounted bills from the counted bills, the bills accumulated in the bill housing are guaranteed to circulate through the transport path, thereby preventing the uncounted bills from remaining when the pin reaches the lowest point. This ensures reliability of the counting procedure.

Furthermore, the output-bill gate can be operated to output the bills while counting the bills. Therefore, the operation that is performed before closing the register can be achieved quickly and accurately.

What is claimed is:

1. A money processing apparatus for processing input and output bills, comprising:

input-bill transport means for transporting input bills;

bill housing means connected to the input-bill transport means for sequentially accumulating and storing bills transferred by the input-bill transport means;

separation and delivery means disposed near the bill housing means for sequentially separating and delivering one bill from other bills accumulated in the bill housing means;

output-bill identifying means disposed near the separation and delivery means for identifying the bills transferred from the separation and delivery means;

transfer means for transporting the bill separated by the separation and delivery means to one of an output port and the bill housing means through the output-bill identifying means; and accumulated-bill dividing means provided at one side of the bill housing means for dividing uncounted bills from counted bills when the bills transferred by the transfer means are returned to the bill housing means for totaling the bills in the bill housing means.

2. A money processing apparatus according to claim 1, wherein said transfer means includes delivered-bill transport means for transporting the bills separated by the separation and delivery means to the output-bill identifying means sequentially; switching gate means for switching a bill transport direction of the bill delivered from the output-bill identifying means to one of the output port and the bill housing means; output-bill transport means for transporting the bill to the output port when the switching gate means is switched to the output port; and circulating transport means for transporting the bill to the bill housing means when the switching gate means is switched to the bill housing means.

3. A money processing apparatus according to claim 1, wherein said accumulated-bill dividing means comprises a dividing arm having one end rotatably supported on a wall surface of the bill housing means; a dividing pin extending from the other end of the dividing arm toward the bill housing means; a guiding section provided in a wall of the bill housing means to allow the dividing pin to be inserted into and pulled out from the bill housing means; a raised portion provided on the wall of the bill housing means for withdrawing the dividing pin from the bill housing means by raising the dividing arm away from the wall of the bill housing means from an uncounted-bill delivery end position to a standby position; a sensor for detecting a lowest point of the dividing pin to indicate that uncounted bills in the bill housing means have been delivered; a motor connected to the dividing arm for rotating the arm from the uncounted-bill delivery end position to the standby position and from the standby position to a position at which the dividing arm falls into the guiding section; and means for transmitting a rotational power of the motor to the dividing arm only when the dividing arm is located between the uncounted-bill delivery end position and the falling position.

4. A money processing apparatus according to claim 3, wherein said accumulated-bill dividing means further includes a spring for urging the dividing arm toward the bill housing means.

5. A money processing apparatus according to claim 4, wherein said dividing arm is located at a position to prevent re-housed bills from entering the separation and delivery means when the sensor detects the lowest point of the dividing pin.

6. A money processing apparatus according to claim 3, wherein said dividing arm is formed of a spring plate so that the dividing arm is urged toward the bill housing means when the dividing arm is raised on the raised portion.

7. A money processing apparatus for processing input and output bills, comprising:

a bill transporting path having a bill inlet, a bill outlet and a circulating path;

bill housing situated in the bill transporting path between the bill inlet and the bill outlet for sequentially accumulating and storing bills transferred from the bill inlet;

a separation and delivery device disposed near the bill housing for sequentially separating and delivering one bill from other bills accumulated in the bill housing;

an output-bill identifying device disposed near the separation and delivery means for identifying the bills transferred from the separation and delivery means; and an accumulated-bill dividing device provided at one side of the bill housing and having a dividing pin to be disposed in the bill housing for dividing uncounted bills from counted bills when the bills taken out by the separation and delivery device are returned to the bill housing for totaling the bills in the bill housing.

8. A money processing apparatus according to claim 7, wherein said accumulated-bill dividing device further includes a dividing arm to which said dividing pin is attached; a guiding groove provided in a wall of the bill housing, said dividing pin being inserted into and pulled out from the bill housing through the guiding groove; a sensor for detecting a lowest position of the dividing pin to indicate that uncounted bills in the bill housing have been delivered; and a motor connected to the dividing arm for rotating the arm from the lowest position to a standby position outside the guiding groove and from the standby position to a top position in the guiding groove.

9. A money processing method for totaling an amount of housed bills, comprising the steps of:

dropping a dividing pin onto a top of bills accumulated in a bill housing;

sequentially delivering the accumulated bills from the bill housing;

sequentially identifying the delivered bills from the bill housing to count identified bills;

circulating the identified bills back to the bill housing to accumulate the identified bills on the dividing pin in the bill housing; and finishing delivery of the bills in the bill housing to complete counting of the bills in the bill housing when the dividing pin has reached a lowest point.

10. A money processing method according to claim 9, wherein said dividing pin enters the bill housing upon falling onto the top of the bills accumulated in the bill housing, and is withdrawn from the bill housing after an arrival of the dividing pin at the lowest point to a start of a next totaling.

* * * * *